US008537192B2

(12) United States Patent
Endo

(10) Patent No.: US 8,537,192 B2
(45) Date of Patent: Sep. 17, 2013

(54) EXPOSURE DEVICE, IMAGE FORMING APPARATUS AND MIRROR ADJUSTING METHOD

(75) Inventor: Takeshi Endo, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 251 days.

(21) Appl. No.: 13/090,977

(22) Filed: Apr. 20, 2011

(65) Prior Publication Data

US 2011/0262185 A1 Oct. 27, 2011

Related U.S. Application Data

(60) Provisional application No. 61/326,555, filed on Apr. 21, 2010.

(51) Int. Cl.

| | |
|---|---|
| ***B41J 27/00*** | (2006.01) |
| ***B41J 2/47*** | (2006.01) |
| ***B41J 2/435*** | (2006.01) |

(52) U.S. Cl.
USPC ..... 347/260; 347/261; 347/237; 347/254; 347/240; 347/247

(58) Field of Classification Search
USPC ..... 347/237, 247, 240, 254, 260, 261
See application file for complete search history.

(56) References Cited

FOREIGN PATENT DOCUMENTS

| | | | |
|---|---|---|---|
| JP | 06089458 | A * | 3/1994 |
| JP | 2001215434 | A * | 8/2001 |
| JP | 2006-259368 | | 9/2006 |
| JP | 2006259368 | A * | 9/2006 |
| JP | 2008-262186 | | 10/2008 |
| JP | 2008262186 | A * | 10/2008 |

* cited by examiner

*Primary Examiner* — Stephen Meier
*Assistant Examiner* — Sarah Al Hashimi
(74) *Attorney, Agent, or Firm* — Patterson & Sheridan, L.L.P.

(57) ABSTRACT

An exposure device includes a mirror to reflect light used for exposure of an object, a holder to hold the mirror, an adhesive that bonds the mirror to the holder and elastically deforms, and an adjusting tool that pushes the mirror to change a direction of the mirror.

15 Claims, 8 Drawing Sheets

EXPOSURE DEVICE, IMAGE FORMING APPARATUS AND MIRROR ADJUSTING METHOD

This application is also based upon and claims the benefit of priority from U.S. provisional application 61/326,555, filed on Apr. 21, 2010; the entire contents of which are incorporated herein by reference.

FIELD

Embodiments described herein relate generally to an exposure device, an image forming apparatus and a mirror adjusting method.

BACKGROUND

In an optical system in which light emitted from a light source reaches an object, a mirror is used. When a position where the mirror is mounted is shifted, or the light incident on the mirror is deviated, the direction (angle) of the mirror is required to be adjusted in order to cause the light reflected by the mirror to be sent in a specified direction.

DETAILED DESCRIPTION

According to an embodiment, an exposure device includes a mirror to reflect light used for exposure of an object, a holder to hold the mirror, an adhesive that bonds the mirror to the holder and elastically deforms, and an adjusting tool that pushes the mirror to change a direction of the mirror.

First Embodiment

Figure 1:
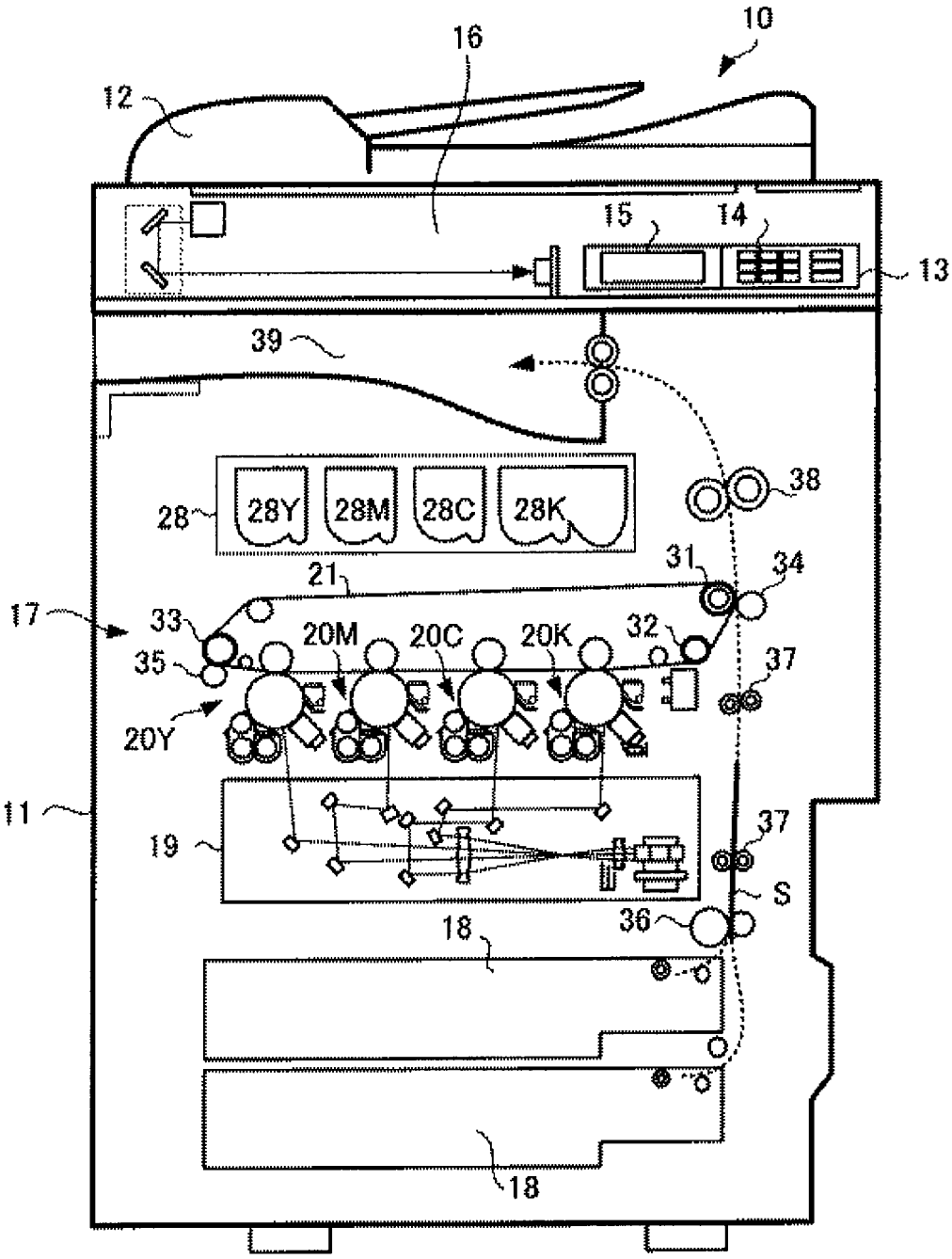
FIG. 1 is a view showing an inner structure of an image forming apparatus.
Figure 2:
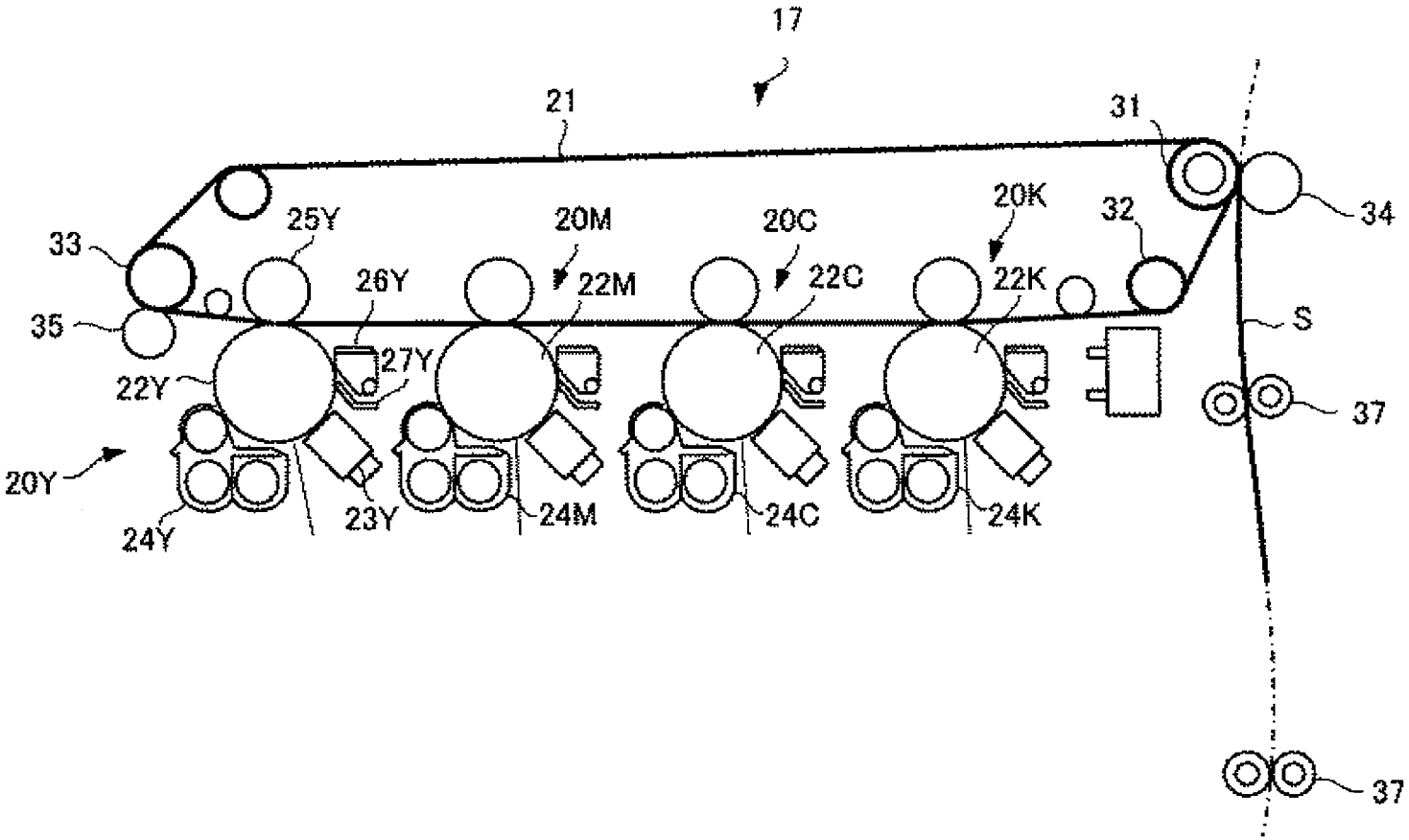
FIG. 2 is a view showing a structure of a printer part.

FIG. 1 is a view showing an inner structure of an image forming apparatus of a first embodiment. FIG. 2 is a view showing a structure of a printer part. A document table is provided at an upper part of a main body 11 of an image forming apparatus 10, and an auto document feeder 12 is provided over the document table. The auto document feeder 12 feeds a document to the document table. An operation panel 13 is provided at an upper part of the main body 11. The operation panel 13 includes an operation part 14 including various keys and a display part 15.

A scanner 16 reads a document placed on the document table and generates image data. A printer part 17 forms an image corresponding to inputted image data onto a sheet. The image data includes image data generated by the scanner 16, and image data transmitted from an external equipment such as a PC (Personal Computer) to the image forming apparatus 10.

The printer part 17 includes image forming parts 20Y, 20M, 20C and 20K of respective colors of yellow (Y), magenta (M), cyan (C) and black (K). The image forming parts 20Y to 20K are disposed along an intermediate transfer belt 21.

The image forming parts 20Y to 20K include photoconductive drums 22Y to 22K. A charging charger 23Y, a developing unit 24Y, a primary transfer roller 25Y, a cleaner 26Y and a blade 27Y are disposed around the photoconductive drum 22Y. Similarly to the photoconductive drum 22Y, a charging charger and the like are disposed around the photoconductive drums 22M to 22K.

A laser beam irradiated from an exposure device 19 and corresponding to yellow reaches an exposure position of the photoconductive drum 22Y. An electrostatic latent image is formed on the surface of the photoconductive drum 22Y by the laser beam. The charging charger 23Y charges the surface of the photoconductive drum 22Y. The developing unit 24Y supplies toner to the photoconductive drum 22Y. The cleaner 26Y uses the blade 27Y and removes toner remaining on the surface of the photoconductive drum 22Y.

A toner cartridge 28 is provided above the image forming parts 20Y to 20K. The toner cartridge 28 supplies toner to the developing units 24Y, 24M, 24C and 24K. The toner cartridge 28 includes toner cartridges 28Y, 28M, 28C and 28K containing toners of the respective colors of yellow (Y), magenta (M), cyan (C) and black (K).

The intermediate transfer belt 21 is stretched over a drive roller 31 and driven rollers 32 and 33, and is in contact with the photoconductive drums 22Y to 22K. The primary transfer roller 25Y applies a primary transfer voltage to the intermediate transfer belt 21 and transfers the toner image of the photoconductive drum 22Y to the intermediate transfer belt 21. The toner images of the photoconductive drums 22M to 22K are also transferred to the intermediate transfer belt 21 by the primary transfer roller.

A secondary transfer roller 34 is provided at a position opposite to the drive roller 31. When a sheet S passes between the drive roller 31 and the secondary transfer roller 34, the secondary transfer roller 34 applies a secondary transfer voltage to the intermediate transfer belt 21, and transfers the toner images on the intermediate transfer belt 21 to the sheet S. A belt cleaner 35 is provided at a position opposite to the driven roller 33.

The exposure device 19 irradiates and scans a laser beam corresponding to image information to the photoconductive drums 22Y to 22K. Electrostatic latent images corresponding to the respective colors (Y, M, C, K) are formed on the photoconductive drums 22Y to 22K by the laser beam.

The main body 11 includes plural paper feed cassettes 18. The paper feed cassettes 18 contain plural sheets. A separation roller 36 takes out the sheet S contained in the paper feed cassette 18. A conveyance roller 37 conveys the sheet from the paper feed cassette 18 to the secondary transfer roller 34.

A fixing unit 38 heats the sheet S conveyed from the secondary transfer roller 34, and fixes the image to the sheet S. The sheet passing through the fixing unit 38 is discharged to a tray 39.

Figure 3:
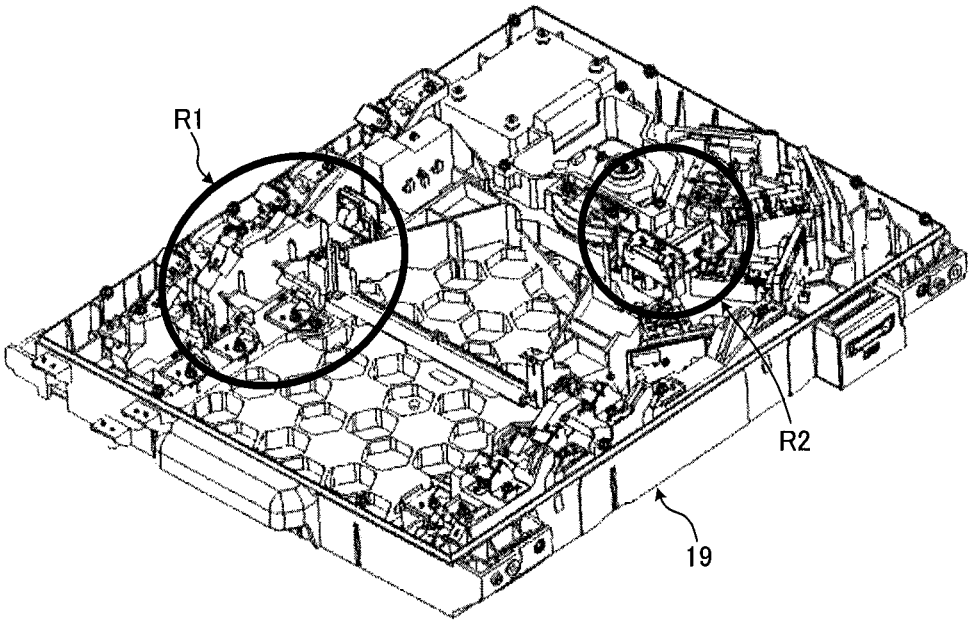
FIG. 3 is a view showing a structure of a part of an exposure device.

In this embodiment, a direction of a mirror is adjusted, and as the mirror, there is a mirror used in the exposure device 19. FIG. 3 is an outer appearance view of a part of the exposure device 19, and mirrors are arranged in portions surrounded by areas R1 and R2.

Figure 4:
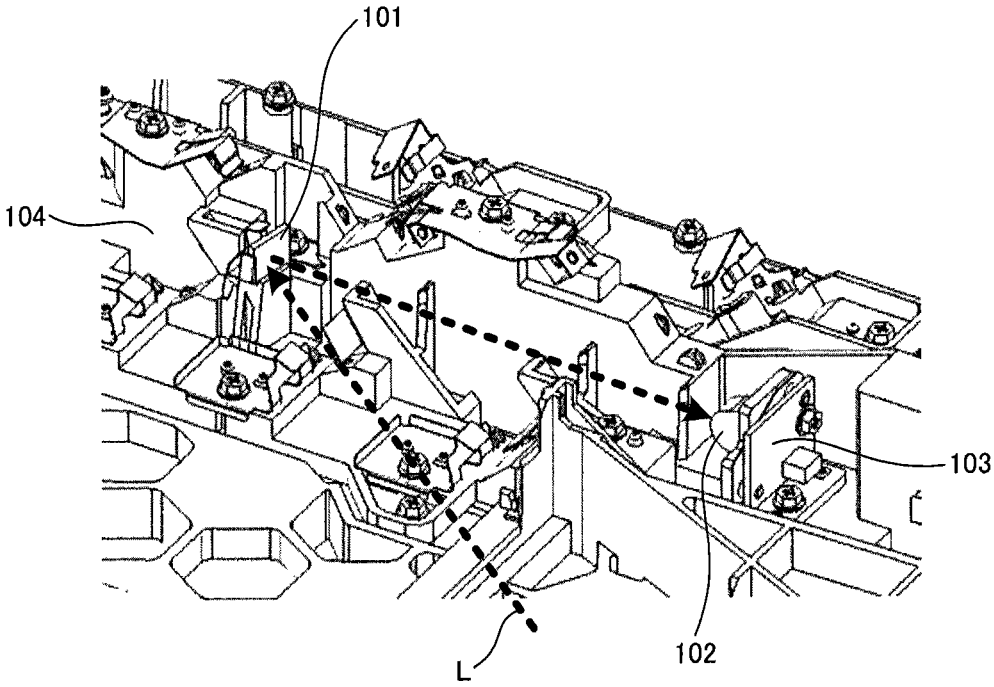
FIG. 4 is an enlarged view of an area R1 of FIG. 2.

FIG. 4 is an enlarged view of the area R1 of FIG. 3. A mirror 101 reflects a laser beam L scanned by a polygon mirror to a condenser lens 102. The condenser lens 102 focuses the laser beam L from the mirror 101 on a horizontal synchronization sensor 103.

The horizontal synchronization sensor 103 receives the laser beam L, and outputs a horizontal synchronization signal. A case 104 of the exposure device 19 holds the mirror 101, and can be formed of, for example, resin.

Figure 5:
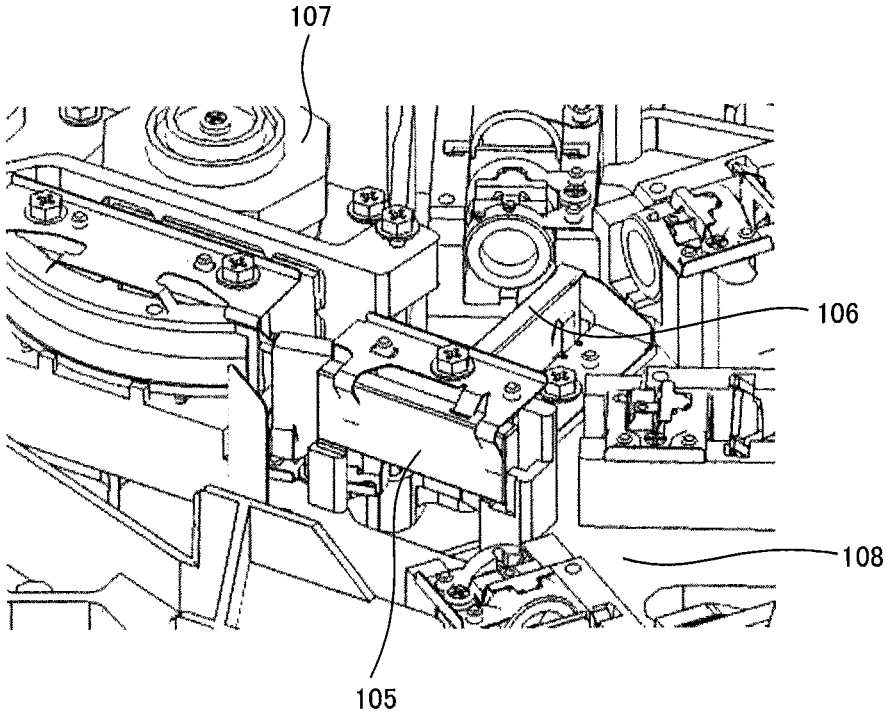
FIG. 5 is an enlarged view of an area R2 of FIG. 2.

FIG. 5 is an enlarged view of the area R2 of FIG. 3. Mirrors 105 and 106 reflect a laser beam from a corresponding light source to a polygon mirror 107. A case 108 of the exposure device 109 holds the mirrors 105 and 106, and can be formed of, for example, metal (aluminum die casting).

Figure 6:
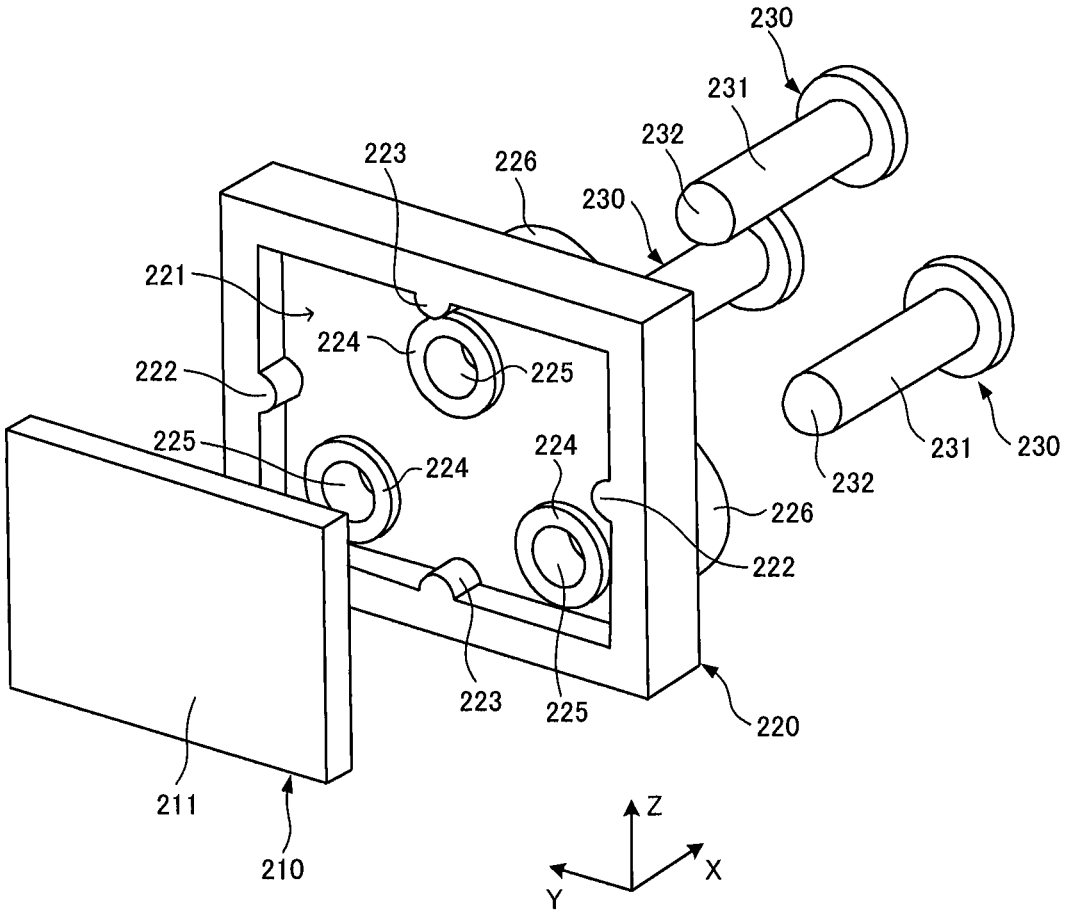
FIG. 6 is an exploded view of a mirror unit of a first embodiment.

A structure of adjusting the direction of the mirror will be described. FIG. 6 is an exploded view of a mirror unit. In FIG. 6, an X-axis, a Y-axis and a Z-axis are axes perpendicular to each other. The relation between the X-axis, the Y-axis and the Z-axis is the same also in FIG. 7 and FIG. 8.

A holder 220 holds a mirror 210. The mirror 210 corresponds to the mirror 101, 105 or 106 explained in FIG. 4 and FIG. 5. A surface 211 of the mirror 210 is a reflecting surface to reflect a laser beam. In this embodiment, although the surface 211 of the mirror 210 is a flat surface, the surface 211 may be a curved surface. The curved surface may be a concave surface or a convex surface.

The holder 220 includes a containing part 221 to contain the mirror 210. The holder 220 includes four projections 222 and 223 in an area surrounding the mirror 210. The projections 222 and 223 protrude to the inside of the holder 220, and contact the outer edge (side surface) of the mirror 210.

The two projections 222 contact the mirror 210, so that the mirror 210 can be positioned in the Y direction. The two projections 223 contact the mirror 210, so that the mirror 210 can be positioned in the Z direction.

In this embodiment, although the projections 222 and 223 are provided at the positions corresponding to the four sides of the mirror 210, the positions where the projections 222 and 223 are provided and the number thereof can be appropriately set. It is sufficient if the mirror 210 can be positioned in at least one of the Y direction and the Z direction.

For example, only the projections 222 may be provided, or only the projections 223 may be provided. In this embodiment, although the two projections 222 are opposite to each other in the Y direction, the two projections 222 may not be opposite to each other in the Y direction. The two projections 223 may also not be opposite to each other in the Z direction.

The holder 220 includes three first cylindrical parts 224 at the inside of the containing part 221. The first cylindrical part 224 extends in the X direction, and a screw groove 225 is formed on the inner surface of the first cylindrical part 224. Three second cylindrical parts 226 are provided on the outer surface of the holder 220, and the second cylindrical parts 226 extend in the X direction.

The second cylindrical part 226 is provided on an extended line of the first cylindrical part 224. The screw groove 225 passes through the holder 220, and is also formed on the inner peripheral surface of the second cylindrical part 226.

A pin 230 as an adjusting tool includes a screw part 231 engaging with the screw groove 225. A tip 232 of the pin 230 is formed of a curved surface (hemisphere face). The pin 230 is inserted into the screw groove 225 from the side of the second cylindrical part 226. When the pin 230 rotates in the state where the screw part 231 and the screw groove 225 are engaged with each other, the tip 232 of the pin 230 protrudes from the tip of the first cylindrical part 224 (see FIG. 7).

When the position where the screw groove 225 engages with the screw part 231 is changed, the pin 230 can be moved in the X direction with respect to the holder 220. When the pin 230 is moved in the X direction, the protrusion amount of the pin 230 from the first cylindrical part 224 can be changed.

The tip 232 of the pin 230 protruding from the first cylindrical part 224 contacts the mirror 210. Specifically, the tip 232 of the pin 230 contacts a rear surface of the mirror 210. The rear surface of the mirror 210 is the surface opposite to the front surface (reflecting surface) 211 in the X direction. The rear surface of the mirror 210 is a flat surface.

Figure 7:
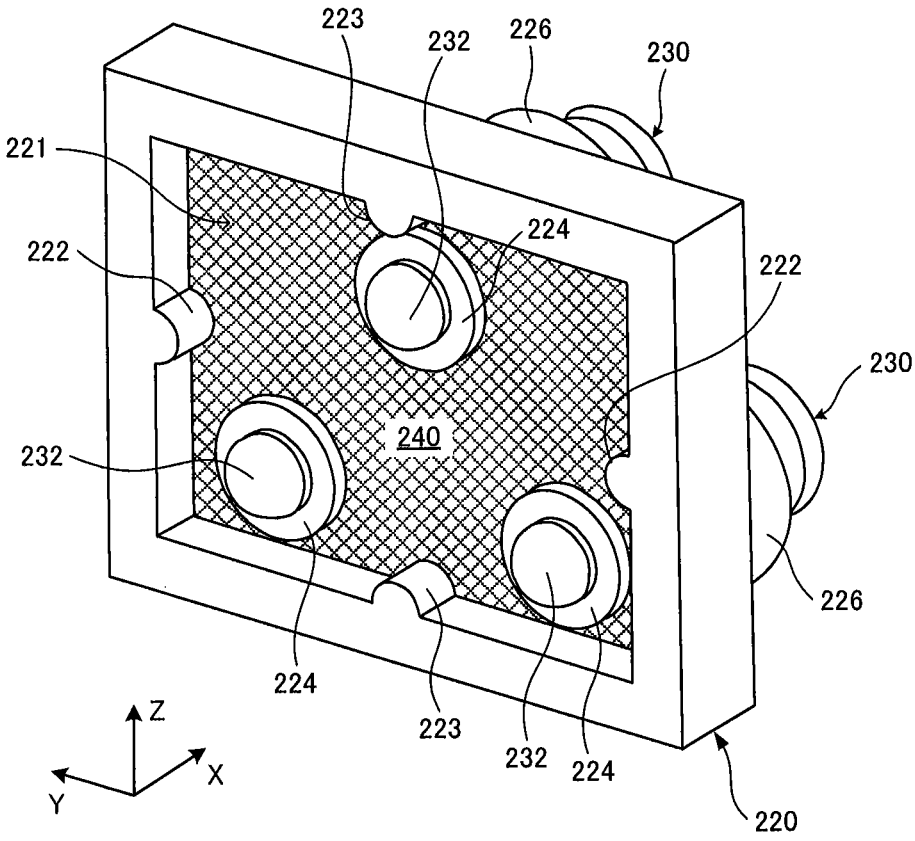
FIG. 7 is a view showing a structure of adjusting a direction of a mirror in the first embodiment.

As shown in FIG. 7, an adhesive 240 is applied to the containing part 221. The thickness (length in the X direction) of the layer of the adhesive 240 is equal to the length of the first cylindrical part 224 in the X direction. Accordingly, the adhesive 240 does not enter the inside of the first cylindrical part 224 and does not contact the pin 230.

The adhesive 240 applied to the containing part 221 contacts the rear surface of the mirror 210. The adhesive 240 bonds the mirror 210 to the holder 220. The adhesive 240 used in this embodiment can elastically deform after the adhesive 240 is cured.

As the adhesive 240, for example, the adhesive shown in Table 1 can be used.

TABLE 1

| Manufacturing company | Product name | Main ingredient | Bonding strength | Extension |
|---|---|---|---|---|
| Cemedine Co., Ltd. | PM100 | Modified silicone | 0.91 [N/mm^2] | 200[%] |
| | PM155 | Epoxy + Modified silicone | 2.1 [N/mm^2] | 180[%] |
| | PM165 | Modified silicone | 2.1 [N/mm^2] | 100[%] |
| | PM300 | Ethyl cyanoacrylate | 2.0 [N/mm^2] | 170[%] |
| | PM200 | Epoxy + Modified silicone | 5.4 [N/mm^2] | 140[%] |
| | Super X | Acrylic modified silicone | 3.7 [N/mm^2] | 220[%] |
| ThreeBond Co., Ltd. | 1530 | Special polymer containing silyl group | 5.9 [MPa] | 280[%] |
| | 1530B | Special polymer containing silyl group | 3.0 [MPa] | 380[%] |
| | 1530C | Special polymer containing silyl group | 4.1 [MPa] | 200[%] |
| | 1532 | Modified silicone | 1.8 [MPa] | 360[%] |

The bonding strength shown in Table 1 includes tensile bonding strength and shear bonding strength. The tensile bonding strength is a tensile load per unit area when the adhesion is broken when a tensile force acts in a direction perpendicular to the adhesive surface of the adhesive. The shear bonding strength is the magnitude of force when the adhesion is broken when the force acts in a direction parallel to the adhesive surface of the adhesive.

The movement amount of the mirror 210 when the direction of the mirror 210 is adjusted, the bonding strength and the extension of the adhesive 240 are considered, and the specific adhesive 240 can be determined.

After the holder 220 and the mirror 210 are bonded to each other by the adhesive 240, when at least one pin 230 of the three pins 230 is moved in the X direction, the direction of the mirror 210 can be changed.

Specifically, when the pin 230 is moved in the X direction and pushes the mirror 210, the direction of the mirror 210 can be changed. The adhesive 240 to bond the mirror 210 to the holder 220 is deformed according to the change of the direction of the mirror 210. A part of the adhesive 240 expands according to the displacement of the mirror 210.

Figure 8:
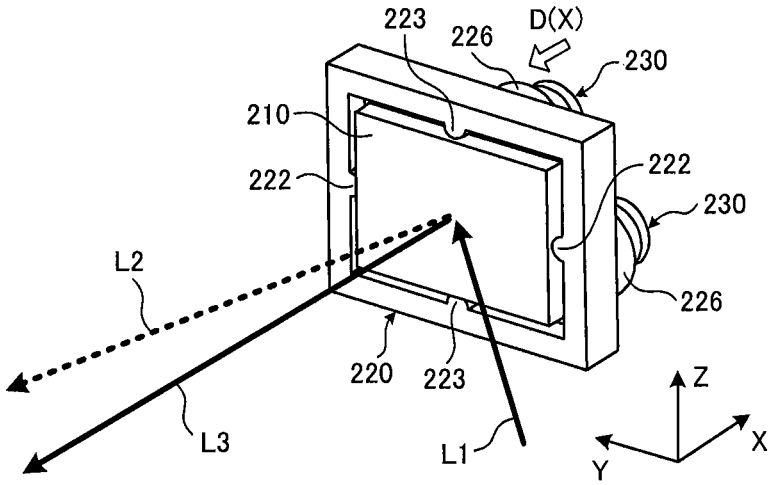
FIG. 8 is a view for explaining a method of adjusting the direction of the mirror in the first embodiment.

In FIG. 8, among the three pins 230, only one pin 230 positioned above is moved in an arrow D (X) direction. Before the pin 230 is moved in the arrow D (X) direction, a laser beam L1 incident on the mirror 210 is reflected by the mirror 210 and advances along an optical path L2.

After the pin 230 is moved in the arrow D (X) direction, the laser beam L1 incident on the mirror 210 is reflected by the mirror 210 and advances along a light path L3. As shown in FIG. 8, the direction of the mirror 210 is changed by moving the pin 230 in the arrow D (X) direction, and the movement direction of the laser beam reflected by the mirror 210 can be changed.

According to this embodiment, among the three pins 230, at least one pin 230 is moved in the X direction and pushes the mirror 210, so that the direction of the mirror 210 can be changed. When the three pins 230 are used, the direction of the mirror 210 can be changed in various directions.

Since the tip 232 of the pin 230 is formed of the curved surface (convex surface), even if the direction of the mirror 210 is changed, a part of the tip 232 can be kept to contact the mirror 210. When the three pins 230 are moved in the same direction by the same amount, the mirror 210 can be moved in the X direction without changing the direction of the mirror 210.

Even if the pin 230 pushes the mirror 210, since the mirror 210 and the holder 220 remain to be bonded by the adhesive 240, the mirror 210 does not come off from the holder 220. The pin 230 can be held at a desired position by engaging the screw part 231 of the pin 230 with the screw groove 225.

The protrusion amount of the pin 230 from the first cylindrical part 224 can be finely adjusted according to the rotation amount of the pin 230. When the protrusion amount of the pin 230 is finely adjusted, the direction of the mirror 210 can be finely adjusted.

In this embodiment, although the adhesive 240 is applied to the whole area of the containing part 221 except for the first cylindrical parts 224, the area to which the adhesive 240 is applied can be appropriately set. It is sufficient if the adhesive 240 bonds the mirror 210 to the holder 220, and can allow the movement of the mirror 210 by the elastic deformation. The adhesive 240 can be applied to only a partial area of the area of the containing part 221 except for the first cylindrical parts 224

Second Embodiment

Figure 9:
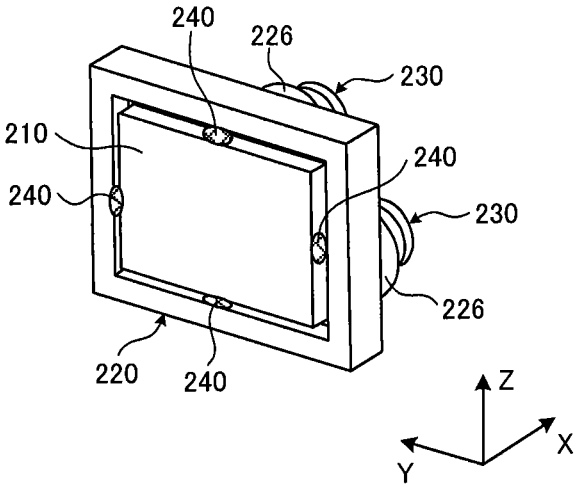
FIG. 9 is an outer appearance view of a mirror unit of a second embodiment.

A mirror unit of a second embodiment will be described. FIG. 9 is an outer appearance view of the mirror unit.

In the first embodiment, the adhesive 240 is applied to the containing part 221 of the holder 220. However, in this embodiment, as shown in FIG. 9, an adhesive 240 is applied to an outer edge of a mirror 210.

In this embodiment, the adhesive 240 is not applied to the containing part 221 of the holder 220. Accordingly, in the holder 220 of this embodiment, the first cylindrical parts 224 explained in the first embodiment can be omitted. Besides, in this embodiment, the projections 222 and 223 explained in the first embodiment are omitted.

As shown in FIG. 9, the adhesive 240 is applied to four places of the outer edge of the mirror 210. The adhesive 240 bonds the mirror 210 to the holder 220. The adhesive 240 is applied to the four places, so that the mirror 210 can be positioned in the Y-Z plane.

In this embodiment, although the adhesive 240 is applied to two positions opposite to each other in the Z direction and two positions opposite to each other in the Y direction, the position to which the adhesive 240 is applied can be appropriately set. It is sufficient if the adhesive 240 bonds the mirror 210 to the holder 220, and allows the movement of the mirror 210 by the elastic deformation.

According to this embodiment, the pin 230 is moved in the X direction and pushes the mirror 210, so that the direction of the mirror 210 can be changed.

In the first embodiment and the second embodiment, although the pin 230 provided with the screw part 231 is used, a pin provided with another structure may be used. It is sufficient if the pin can be moved in the X direction, and can be fixed to the holder 220 at specified positions (plural positions) in the X direction.

For example, the pin 230 is provided with a plate spring, and plural grooves engaging with the plate spring are provided in the holder 220. The position of the pin in the X direction can be adjusted by changing the position where the plate spring engages with the groove. The direction of the mirror 210 can be adjusted by adjusting the position of the pin in the X direction.

In the first embodiment and the second embodiment, although the three pins 230 are used and the direction of the mirror 210 is adjusted, the positions where the pins 230 are disposed and the number thereof can be appropriately set.

Specifically, one pin 230 is used, and the direction of the mirror 210 can be adjusted. For example, in a structure in which the tip 232 of the pin 230 contacts a portion deviated from the center of the mirror 210, when the pin 230 pushes the mirror 210, the direction of the mirror 210 can be changed. The center of the mirror 210 is the center of the mirror 210 on the Y-Z plane.

Even when two pins 230 are used, the direction in which the direction of the mirror 210 is changed can be changed according to the positions where the two pins 230 are disposed.

In addition to the structure of the first embodiment and the second embodiment, the holder 220 can be provided with a stopper. The stopper contacts the mirror 210, and prevents the mirror 210 from being displaced by a specified amount or more. The stopper can be provided on the surface of the holder 220 on which the containing part 221 is formed.

The movement amount of the pin 230 in the X direction can be limited by using the second cylindrical part 226. Specifically, the length of the second cylindrical part 226 in the X direction and the length of the pin 230 in the X direction are appropriately determined, so that the protrusion amount (maximum value) of the pin 230 from the first cylindrical part 224 can be determined. When the protrusion amount (maximum value) of the pin 230 is determined, it is possible to prevent the pin 230 from pushing the mirror 310 until the adhesion of the adhesive 240 is broken.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An exposure device comprising:

a mirror to reflect light used for exposure of an object;

a holder to hold the mirror;

an adhesive that bonds the mirror to the holder and elastically deforms; and an adjusting tool configured to move the mirror to change a reflecting direction of the mirror, a tip of the adjusting tool contacting the mirror, and including a curved surface protruding to the mirror.

2. The device of claim 1, wherein the adjusting tool includes a screw part to engage a screw hole formed in the holder.

3. The device of claim 1, wherein the adjusting tool is supported by the holder and is movable relative to the holder.

4. The device of claim 1, wherein a plurality of the adjusting tools are provided.

5. An exposure device comprising:

a mirror to reflect light used for exposure of an object;

a holder to hold the mirror;

an adhesive that bonds the mirror to the holder and elastically deforms; and an adjusting tool that contacts a surface of the mirror opposite to a reflecting surface and is configured to move the mirror to change a reflecting direction of the mirror.

6. The device of claim 5, wherein the adhesive contacts the surface of the mirror opposite to the reflecting surface.

7. The device of claim 6, wherein the holder includes a containing part to contain the adhesive.

8. The device of claim 5, wherein the adjusting tool is supported by the holder and is movable relative to the holder.

9. The device of claim 5, wherein the adjusting tool includes a screw part to engage a screw hole formed in the holder.

10. The device of claim 5, wherein the adjusting tool includes a plurality of adjusting tools.

11. An exposure device comprising:

a mirror to reflect light used for exposure of an object;

a holder to hold the mirror and including a projection to position the mirror in a plane parallel to a reflecting surface of the mirror;

an adhesive that bonds the mirror to the holder and elastically deforms; and an adjusting tool configured to move the mirror to change a direction of the mirror.

12. An image forming apparatus comprising:

a photoreceptor;

a mirror to reflect light used for exposure of the photoreceptor;

a holder to hold the mirror;

an adhesive that bonds the mirror to the holder and elastically deforms;

an adjusting tool configured to move the mirror to change a reflecting direction of the mirror, a tip of the adjusting tool contacting the mirror, and including a curved surface protruding to the mirror; and a developing unit to supply toner to the photoreceptor.

13. An image forming apparatus comprising:

a photoreceptor;

a mirror to reflect the light used for exposure of the photoreceptor;

a holder to hold the mirror;

an adhesive that bonds the mirror to the holder and elastically deforms;

an adjusting tool that contacts a surface of the mirror opposite to a reflecting surface and is configured to move the mirror to change a reflecting direction of the mirror; and a developing unit to supply toner to the photoreceptor.

14. The apparatus of claim 13, wherein the adhesive contacts the surface of the mirror opposite to the reflecting surface.

15. The apparatus of claim 14, wherein the holder includes a containing part to contain the adhesive.

* * * * *